US009178296B2

(12) United States Patent
Funamura et al.

(10) Patent No.: US 9,178,296 B2
(45) Date of Patent: Nov. 3, 2015

(54) CONNECTOR FOR PLACEMENT IN BOARD OPENING

(71) Applicant: Apple Inc., Cupertino, CA (US)

(72) Inventors: Joshua Funamura, San Jose, CA (US); Phillip Satterfield, Oakland, CA (US); Zheng Gao, San Jose, CA (US); George Marc Simmel, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 139 days.

(21) Appl. No.: 13/657,262

(22) Filed: Oct. 22, 2012

(65) Prior Publication Data

US 2014/0113493 A1 Apr. 24, 2014

(51) Int. Cl.

| | |
|---|---|
| ***H01R 24/00*** | (2011.01) |
| ***H01R 12/71*** | (2011.01) |
| ***H01R 13/502*** | (2006.01) |
| ***H01R 13/74*** | (2006.01) |

(52) U.S. Cl.

CPC ..... *H01R 12/716* (2013.01); *H01R 13/502* (2013.01); *H01R 13/74* (2013.01); *Y10T 29/49208* (2015.01)

(58) Field of Classification Search

USPC ..... 439/626, 660, 607.01, 607.58, 79, 439/607.35, 493

See application file for complete search history.

(56) References Cited

U.S. PATENT DOCUMENTS

| | | | | |
|---|---|---|---|---|
| 7,618,293 | B2 * | 11/2009 | Wu | 439/660 |
| 7,699,663 | B1 * | 4/2010 | Little et al. | 439/660 |
| 2010/0151736 | A1 * | 6/2010 | Long | 439/626 |
| 2010/0233907 | A1 * | 9/2010 | Wu | 439/607.58 |
| 2011/0124229 | A1 * | 5/2011 | Li et al. | 439/626 |
| 2011/0256764 | A1 * | 10/2011 | Wu | 439/607.01 |
| 2011/0256773 | A1 * | 10/2011 | Hsu et al. | 439/626 |
| 2012/0244753 | A1 * | 9/2012 | Moedinger | 439/626 |

* cited by examiner

*Primary Examiner* — Jean F Duverne

(74) *Attorney, Agent, or Firm* — Kilpatrick Townsend & Stockton LLP

(57) ABSTRACT

Connector receptacles that may have a reduced height when combined with a printed circuit board and reduce wasted space inside an electronic device. One example may provide a connector receptacle that fits in an opening in a printed circuit board. The connector receptacle may also be angled at an oblique angle relative to the printed circuit board such that its face may be flush with a highly stylized device enclosure.

20 Claims, 12 Drawing Sheets

CONNECTOR FOR PLACEMENT IN BOARD OPENING

BACKGROUND

The number and types of electronic devices available to consumers have increased tremendously the past few years, and this increase shows no signs of abating. Devices such as portable computing devices, tablets, desktop computers, laptops, all-in-one computers, cell phone, smart phones, media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

Devices typically have openings that allow access to connector receptacles. These openings may provide access to one or more contacts in the receptacles, which may mate with corresponding contacts in connector inserts. The connector receptacles often are located on a printed circuit board, such as a main or mother board. The one or more contacts in the connector receptacle may connect to corresponding traces on the printed circuit board.

These various electronic devices are continually becoming thinner and more sleek. That is, the trend is away from thicker, bulkier devices. But stacking a connector insert on a printed circuit board in this way limits the possible height or thickness of a device. That is, a device has to be high or thick enough to encase both the height of a printed circuit board and a connector receptacle.

The portion of a printed circuit board where a connector receptacle resides is not typically used for any purpose other than to provide mechanical support for the connector receptacle and to provide traces for connection to the contacts in the connector receptacle such that signals and power supplies may be conveyed to and from other circuits on the printed circuit board. This means that some printed circuit board area is wasted, which wastes space inside the electronic device.

Thus, what is needed are connector receptacles that have a reduced height when mated with a printed circuit board and reduce wasted printed circuit board area.

SUMMARY

Accordingly, embodiments of the present invention may provide connector receptacles that may have a reduced height when combined with a printed circuit board and reduce wasted space inside an electronic device. An exemplary embodiment of the present invention may provide a connector receptacle that fits in an opening in a printed circuit board. The connector receptacle may also be angled at an oblique angle relative to the printed circuit board such that its face may be flush with a highly stylized device enclosure.

An illustrative embodiment of the present invention may provide a connector receptacle arranged to fit in an opening in a printed circuit board. To enable this arrangement, the connector may include contacts that are bent and angled generally upward such that they can be attached to a top surface of the printed circuit board. In one specific embodiment of the present invention, some of the contacts may have a first portion to make electrical contact with a corresponding contact on a connector insert, a second lateral portion at a right angle to the first portion, a third portion angled upward, a fourth lateral portion, and a fifth downward portion. The fifth downward portion may form a through-hole contact, though surface mount contacts or other types of contacts may also be formed. In this and other embodiments of the present invention, other contacts may have a first portion to make electrical contact with a corresponding contact on a connector insert, a second lateral portion, a third portion angled upward, a fourth lateral portion, and a fifth downward portion. Again, the fifth downward portion may form a through-hole contact, though surface mount contacts or other types of contacts may also be formed.

Another illustrative embodiment of the present invention may provide a connector receptacle where a top portion of the connector receptacle is above a printed circuit board and a bottom portion of the connector receptacle is below the printed circuit board. This connector may be shielded by a bottom shell portion covering at least a portion of a bottom of the housing, and a top shell portion covering at least a portion of a top of the housing.

Another illustrative embodiment of the present invention may provide a connector receptacle is arranged to provide an opening flush with a highly stylized or curved device enclosure. These connector receptacles may be tilted or angled relative to a printed circuit board in one or more axes.

In specific embodiment of the present invention, a face of the connector may have a longitudinal axis in a first direction and a transverse axis in a second direction, the first direction orthogonal to the second direction. The connector may be arranged such that the longitudinal axis is not parallel to or orthogonal to a printed circuit board supporting the connector and the transverse axis is not parallel to or orthogonal to the printed circuit board. That is, the connector may be arranged such that the longitudinal axis forms an oblique angle to a printed circuit board supporting the connector and the transverse axis forms an oblique angle to the printed circuit board.

Another illustrative embodiment of the present invention may provide a method of assembling a connector receptacle. This method may include inserting a plurality of first contacts into a first housing portion, forming a second housing around a plurality of second contacts, fitting the second housing to the first housing, inserting the second housing into a third housing, attaching ground contacts to a top and a bottom of the third housing, attaching a bottom shell portion substantially around a bottom portion of the third housing, and attaching a top shell portion around sides of a top portion of the third housing.

Embodiments of the present invention may provide connector receptacles for various types of devices, such as portable computing devices, tablets, desktop computers, laptops, all-in-one computers, cell phone, smart phones, media phones, storage devices, portable media players, navigation systems, monitors and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of interfaces.

While embodiments of the present invention are particularly suited to connector receptacles that accept connector inserts, embodiments of the present invention may be used to form other connections. For example, board-to-board, wire-to-board, and other types of connections may be improved by employing embodiments of the present invention.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
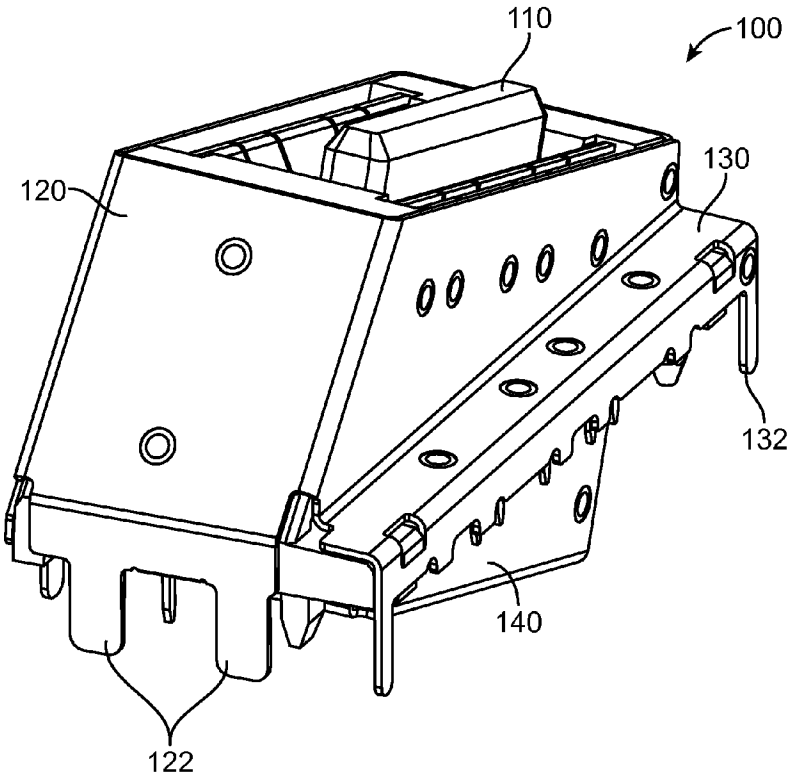
FIG. 1 illustrates a connector receptacle according to an embodiment of the present invention.

FIG. 1 illustrates a connector receptacle according to an embodiment of the present invention. This figure, as with the other included figures, is shown for illustrative purposes and does not limit either the possible embodiments of the present invention or the claims.

Connector receptacle 100 may include tongue 110, top shell portion 120, side shell portion 130, and bottom shell portion 140. Top shell portion 120 may include tabs 122. Side shell portion 130 may be formed as part of, or attached to, top shell portion 120. Side shell portion 130 may include tabs 132. Tabs 122 and 132 may be soldered or otherwise fixed to openings in a printed circuit board, such as a motherboard, main logic board, or other appropriate substrate.

Again, some device enclosures are becoming so narrow that it may be difficult to fit a connector receptacle and main logic board in its width. Accordingly, embodiments of the present invention may provide connector receptacles that reside in an opening in a printed circuit board. In this way, the thickness of the combination of the connector and printed circuit board is reduced to the depth of the printed circuit board.

In this example, an opening in a printed circuit board may be formed to allow the insertion of bottom shell portion 140. Connector receptacle 110 may then rest on top of the printed circuit board. Again, tabs 122 and 132, as well as contacts (not shown) may be inserted into openings on a top side of the printed circuit board. In such a configuration, a bottom portion, roughly corresponding to bottom shell 140, may reside below the printed circuit board, while a top portion, roughly corresponding to top shell portion 120, may reside above the printed circuit board.

Again, these connector receptacles may reside in a device enclosure that is highly stylized and that may have various curves and shapes. It may be desirable for an opening of connector receptacle 100 to be flush against an opening in such a stylized device enclosure. Accordingly, connector receptacle 100 may be angle or tilted in one or more axes.

Embodiments of the present invention may provide connector receptacles for various types of devices, such as portable computing devices, tablets, desktop computers, laptops, all-in-one computers, cell phone, smart phones, media phones, storage devices, portable media players, navigation systems, monitors and other devices. These connector receptacles may provide pathways for signals and power compliance with various standards, such as Universal Serial Bus (USB), a High-Definition Multimedia Interface (HDMI), Digital Visual Interface (DVI), power, Ethernet, DisplayPort, Thunderbolt, Lightning, and other types of interfaces. An example of one such USB connector is shown in the following figures.

Figure 2:
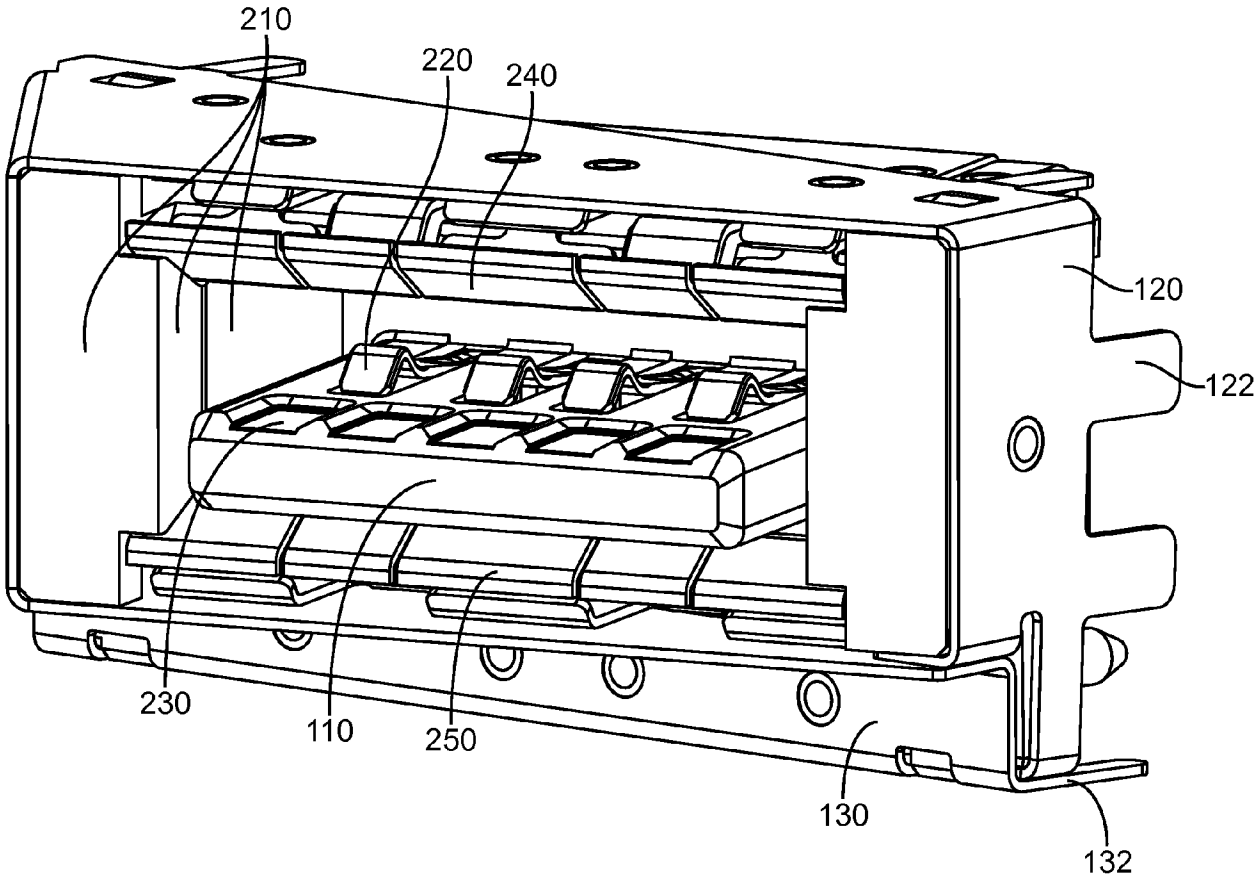
FIG. 2 illustrates an opening for a USB connector according to an embodiment of the present invention.

FIG. 2 illustrates an opening for a USB connector according to an embodiment of the present invention. Connector 100 may include housing 210 supporting tongue 110. First contacts 220 may reside on tongue 110, while second contacts 230 may reside in tongue 110. Ground contacts 240 and 250 may reside above and below tongue 110. Top shell portion 120 may surround sides of the opening of connector receptacle 100. Side shell portion 130 may attach to, or be formed as part of, top shell portion 120. Top shell portion 120 may include tabs 122, while side shell portion 130 may include tabs 132.

Figure 3:
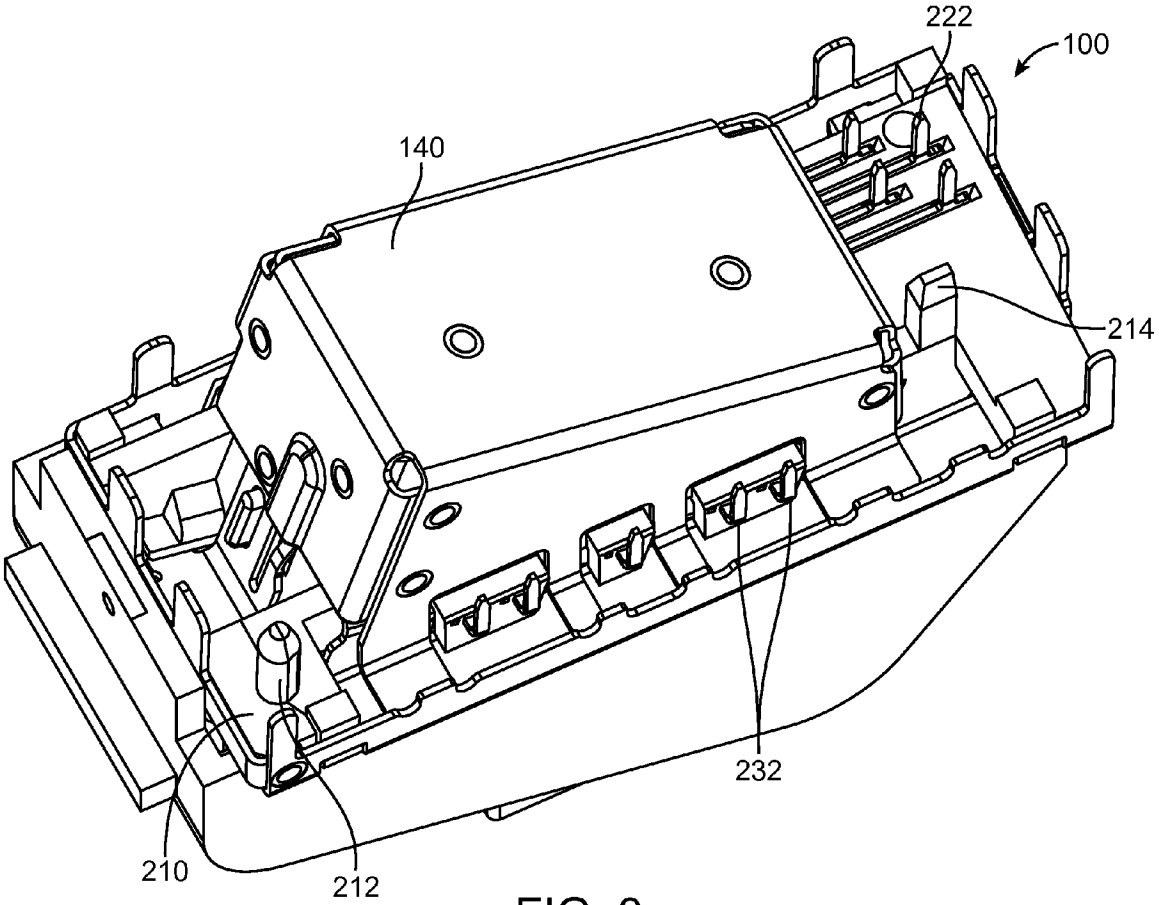
FIG. 3 illustrates a bottom side of a connector receptacle according to an embodiment of the present invention.

FIG. 3 illustrates a bottom side of a connector receptacle according to an embodiment of the present invention. Connector receptacle 100 may include a bottom shell portion 140, and contact through-hole portions 222 and 232. Posts 212 and 214 may be formed as part of housing 210 to provide mechanical stability. Specifically, posts 212 and 214 may be inserted into openings on a printed circuit board or other appropriate substrate.

To enable connector receptacle 100 to resign partially below a printed circuit board, contacts in connector receptacle 100 may include upwardly bent portions such that these contacts may reach a top surface of a printed circuit board. Examples of these contacts, as well as a method of manufacturing connector receptacles according to an embodiment of the present invention, are shown in the following figures.

Figure 4:
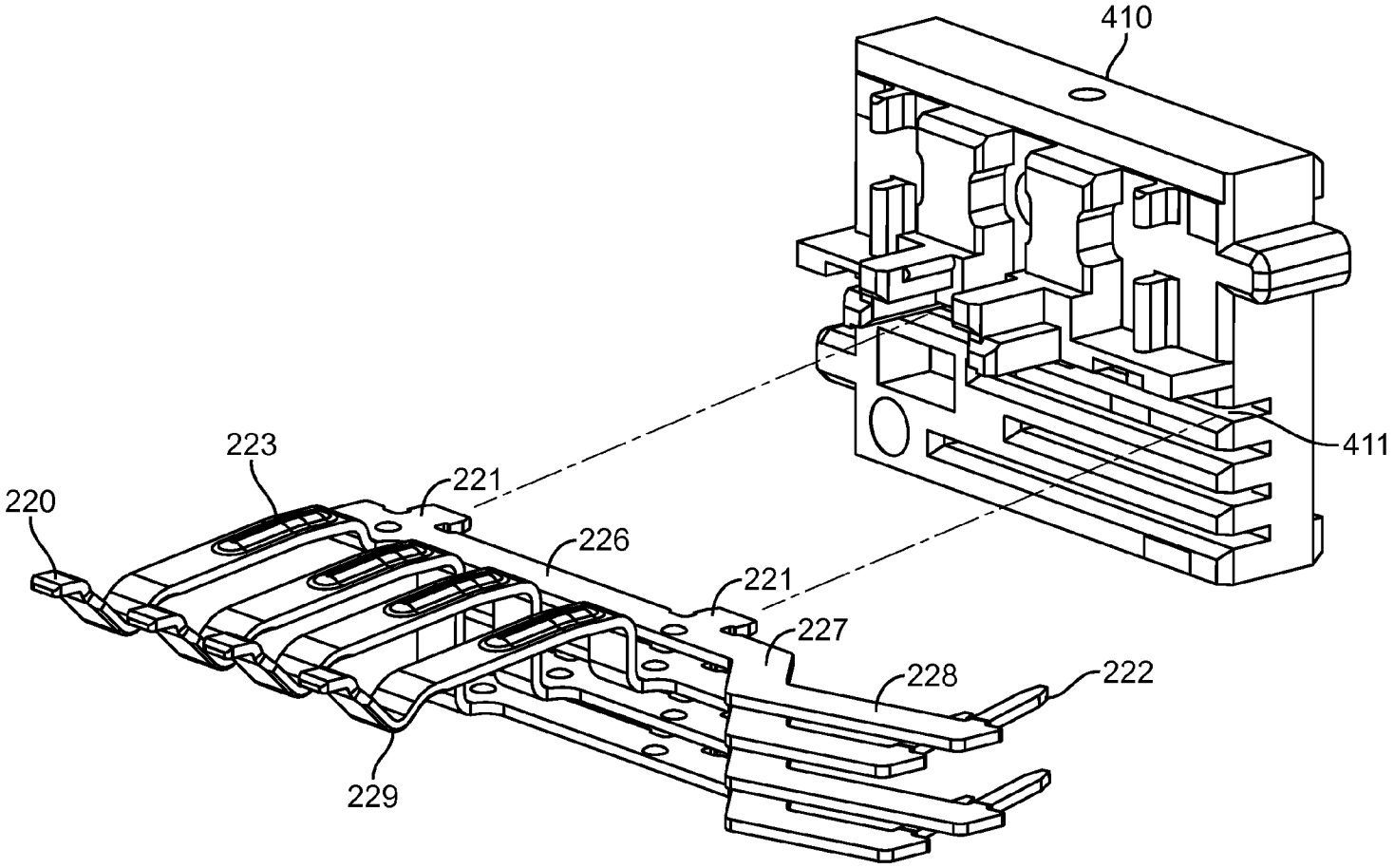
FIGS. 4-11 illustrate steps in the manufacturing of a connector receptacle according to an embodiment of the present invention.

FIG. 4 illustrates a step in the manufacturing of a connector receptacle according to an embodiment of the present invention. This figure illustrates a number of first contacts 220 being inserted into a first housing 410. First contacts 220 may include tabs 221 that are inserted into slots 411 on housing 410. Contacts 220 may include a first portion 229 to form an electrical connection with contacts on a connector insert when it is inserted into connector receptacle 100. First portion 229 of contacts 220 may include reinforced areas 223. Reinforced areas 223 may be stamped trenches that increase lifetime and improve electrical connections. Contacts 220 may further include a first lateral portion 226 and substantially a right angle to first portions 229. Contacts 220 may further include angle portions 227, second lateral portion 228, and through-hole portion 222. Through-hole portion 222 may be replaced by surface mount contacts in some embodiments of the present invention.

Figure 5:
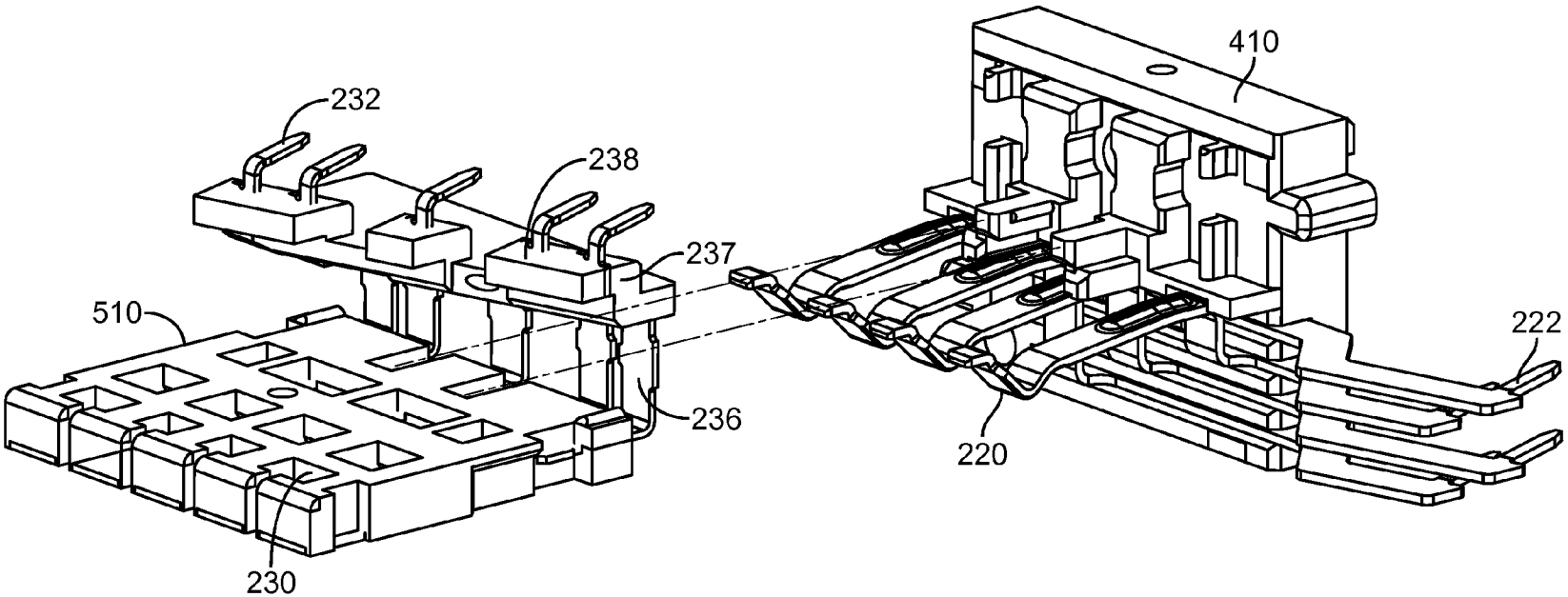

FIG. 5 illustrates another step in the manufacturing of a connector receptacle according to an embodiment of the present invention. In this figure, a second housing 510 may be injection molded around second contacts 230. Second contacts 230 may include contact portions for making electrical connections with contacts on a connector insert when it is inserted into connector receptacle 100. Contacts 230 may further include first lateral portions 236, upward portions 237, second lateral portions 238, and through-hole or surface mount portions 232. First housing 410 and second housing 510 may be fitted together. As can be seen, first contacts 220 and second contacts 230 are at right angles, and may eventually exit the assembled housing of connector 100 at right angles.

Figure 6:
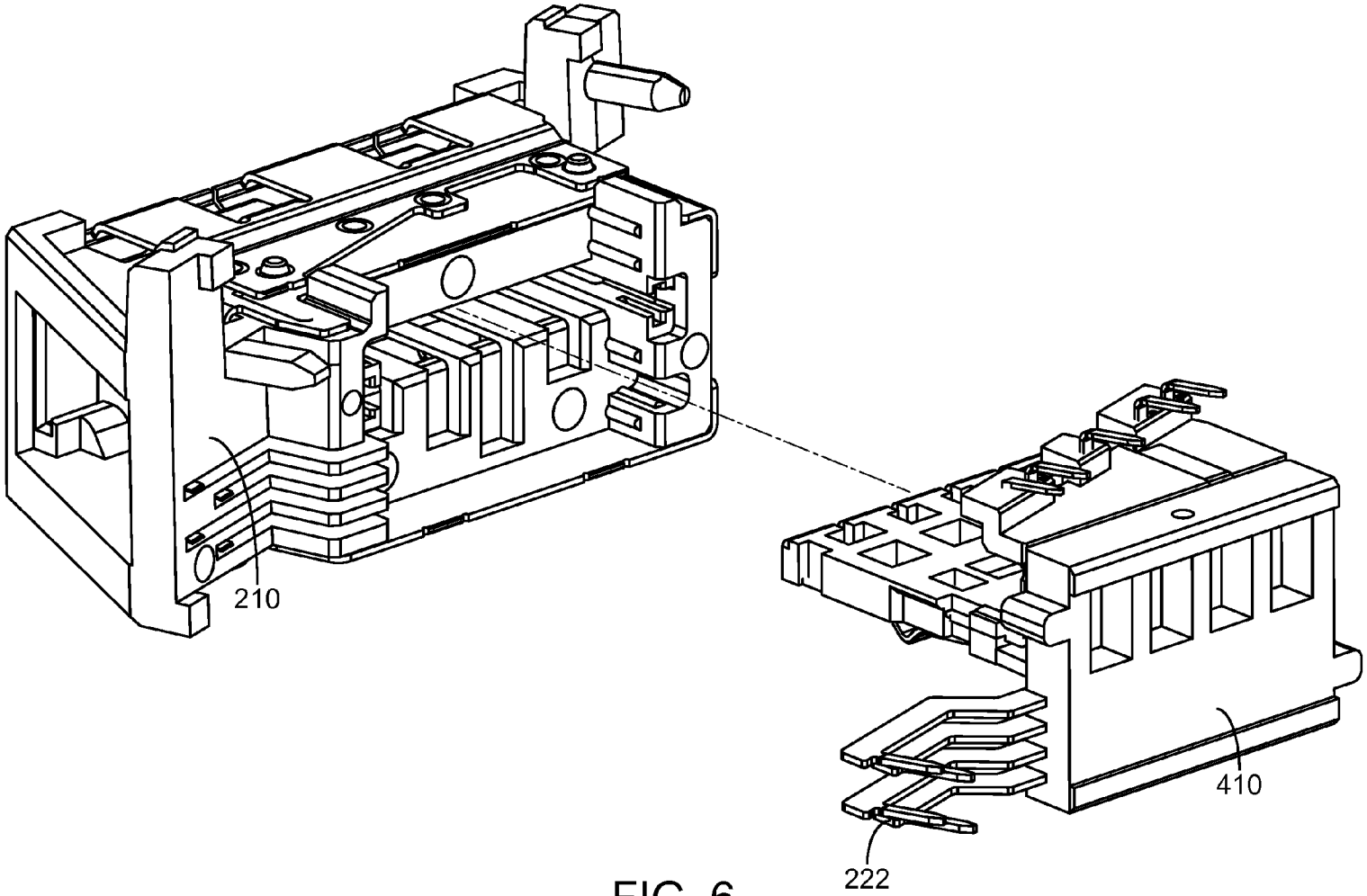

FIG. 6 illustrates a step in the manufacturing of a connector receptacle according to an embodiment of the present invention. In this figure, first housing 410 may be fitted to a third housing 210.

Figure 7:
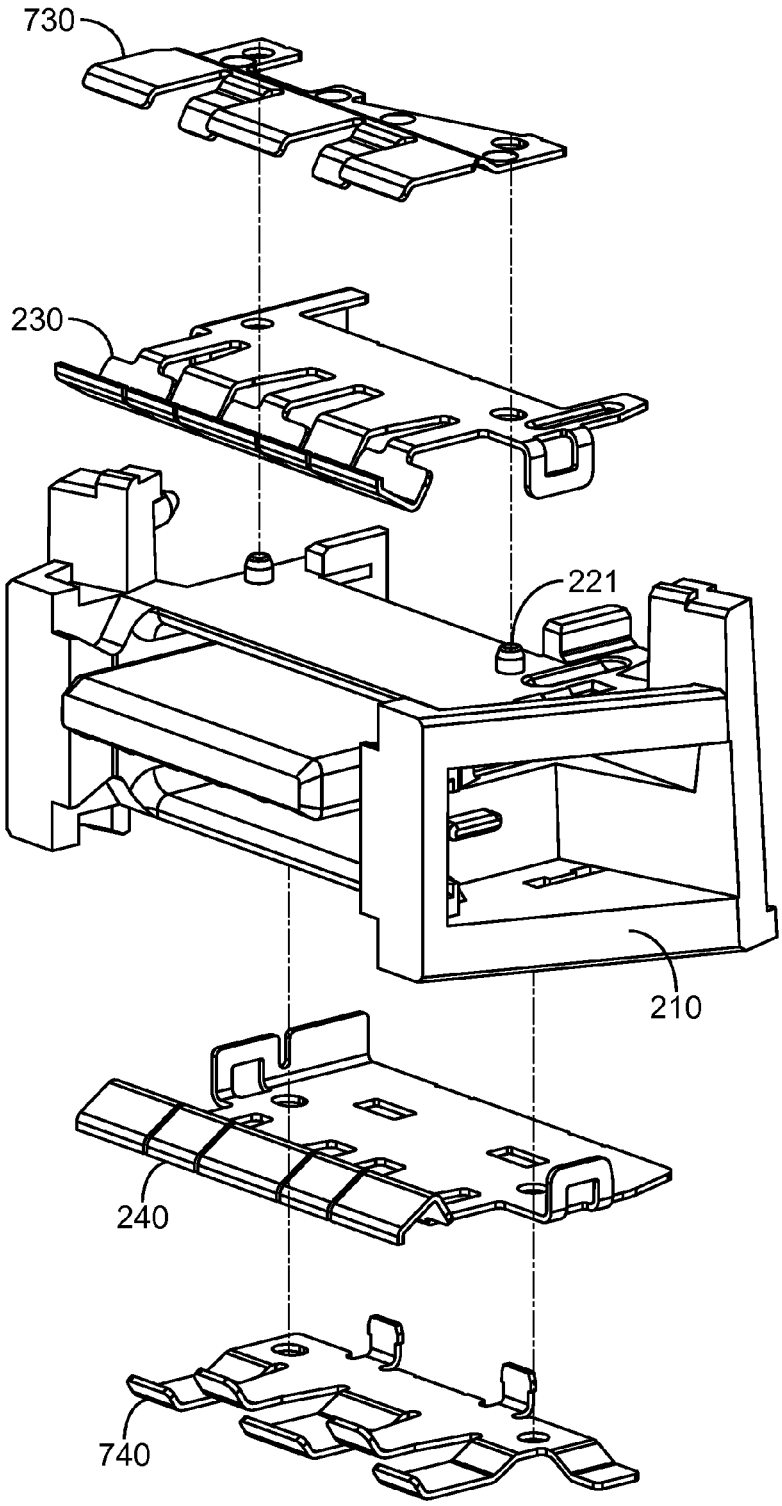

FIG. 7 illustrates another step in the manufacturing of a connector receptacle according to an embodiment of the present invention. In this figure, top ground piece 730 may be fixed to top ground contacts 230, and the combination may be fixed to posts 211 of housing 210. Similarly, bottom ground piece 740 may be fixed to bottom ground contacts 230, which may then be fixed to posts (not shown) on housing 210. These ground pieces and ground contacts may be soldered, laser or spot welded, or otherwise fixed together.

Figure 8:
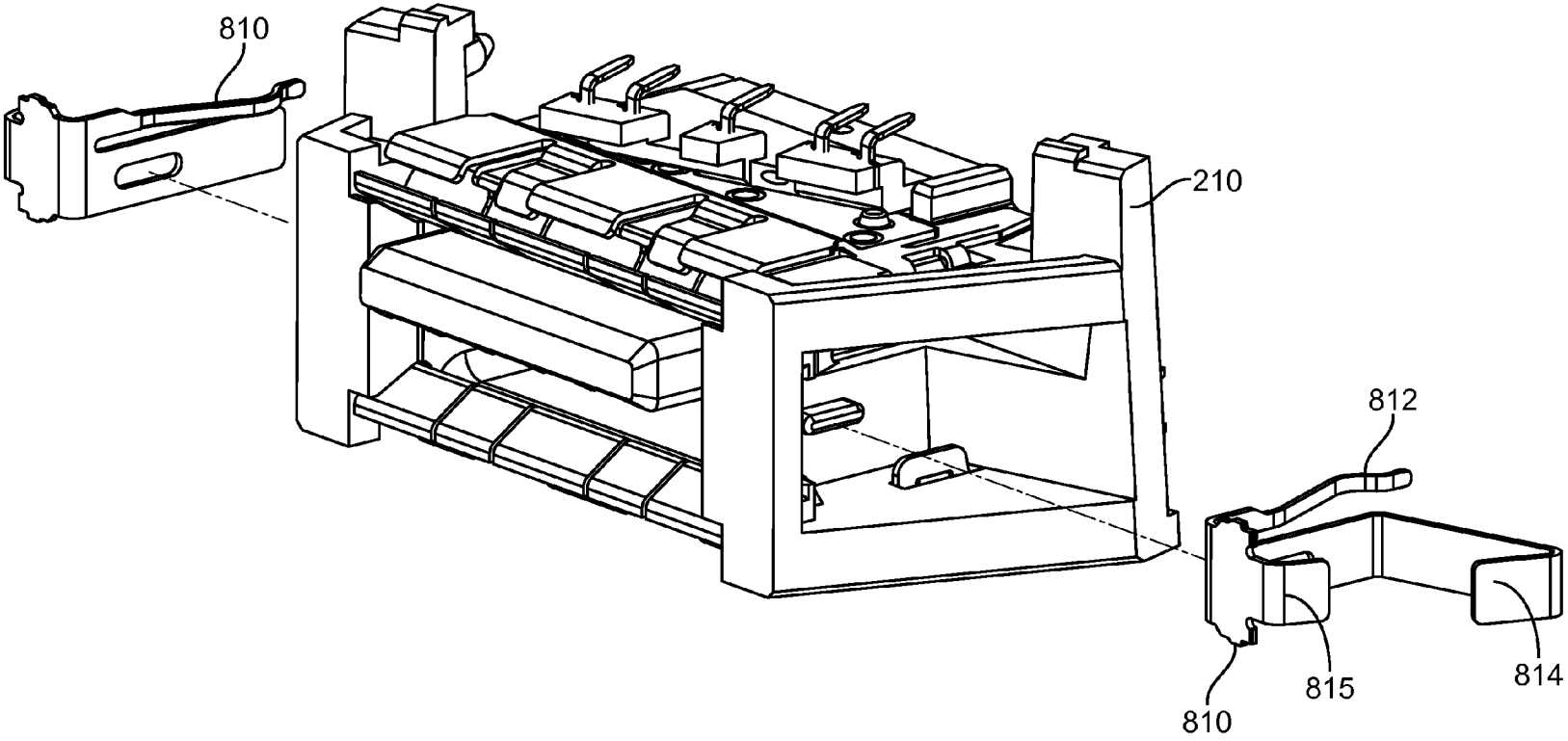

FIG. 8 illustrates another step in the manufacturing of a connector receptacle according an embodiment of the present invention. In this figure, fingers 810 may be inserted into housing 210. Fingers 810 may include contacting portion 812 to contacts sides of a connector insert when the connector insert is inserted into connector receptacle 100. Fingers 810 may include welding surfaces 814, which may eventually be fixed to a shell portion such as top shell portion 120.

Figure 9:
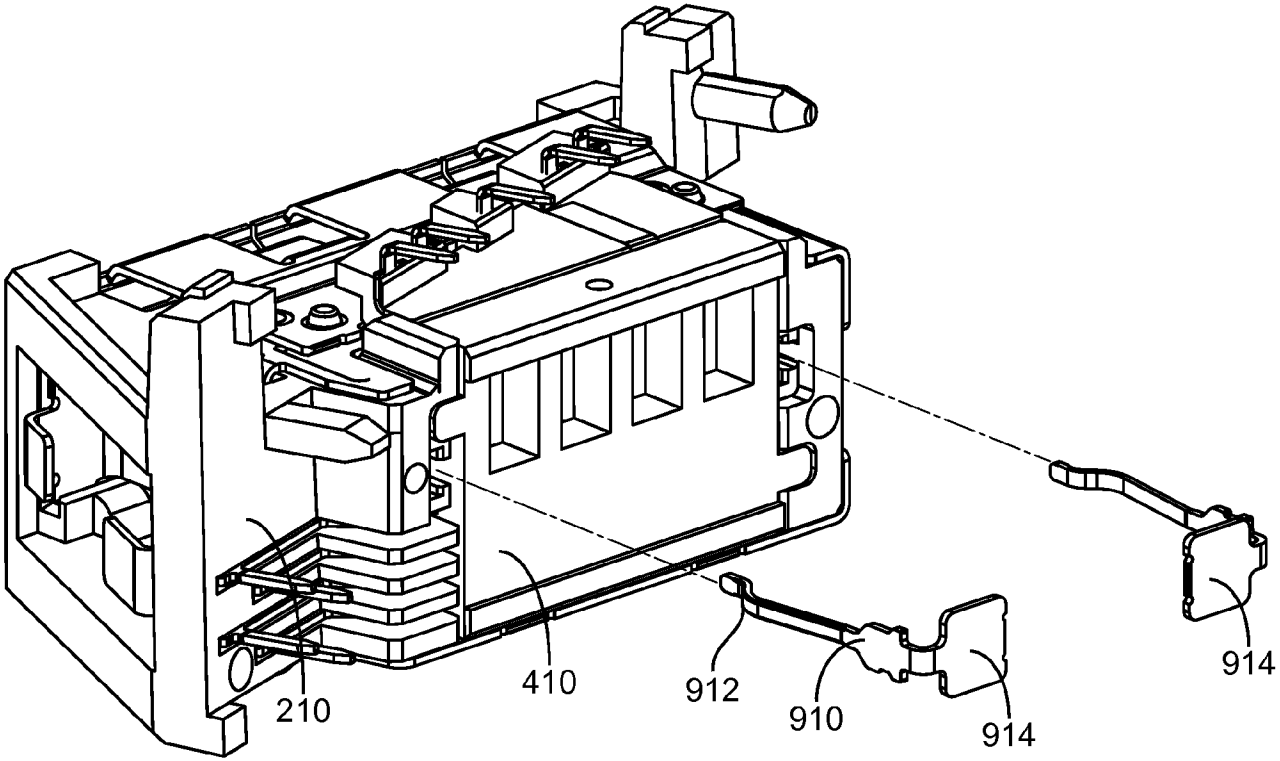

FIG. 9 illustrates another step in the manufacturing of a connector receptacle according to an embodiment of the present invention. In this figure, fingers 910 may be inserted into a bottom of housing 210. Fingers 910 may include contacting portions 912, which may contacts sides of a connector insert when the connector insert is inserted into connector receptacle 100. Fingers 910 may also include welding surfaces 914, which may eventually be fixed to bottom shell portion 140.

Figure 10:
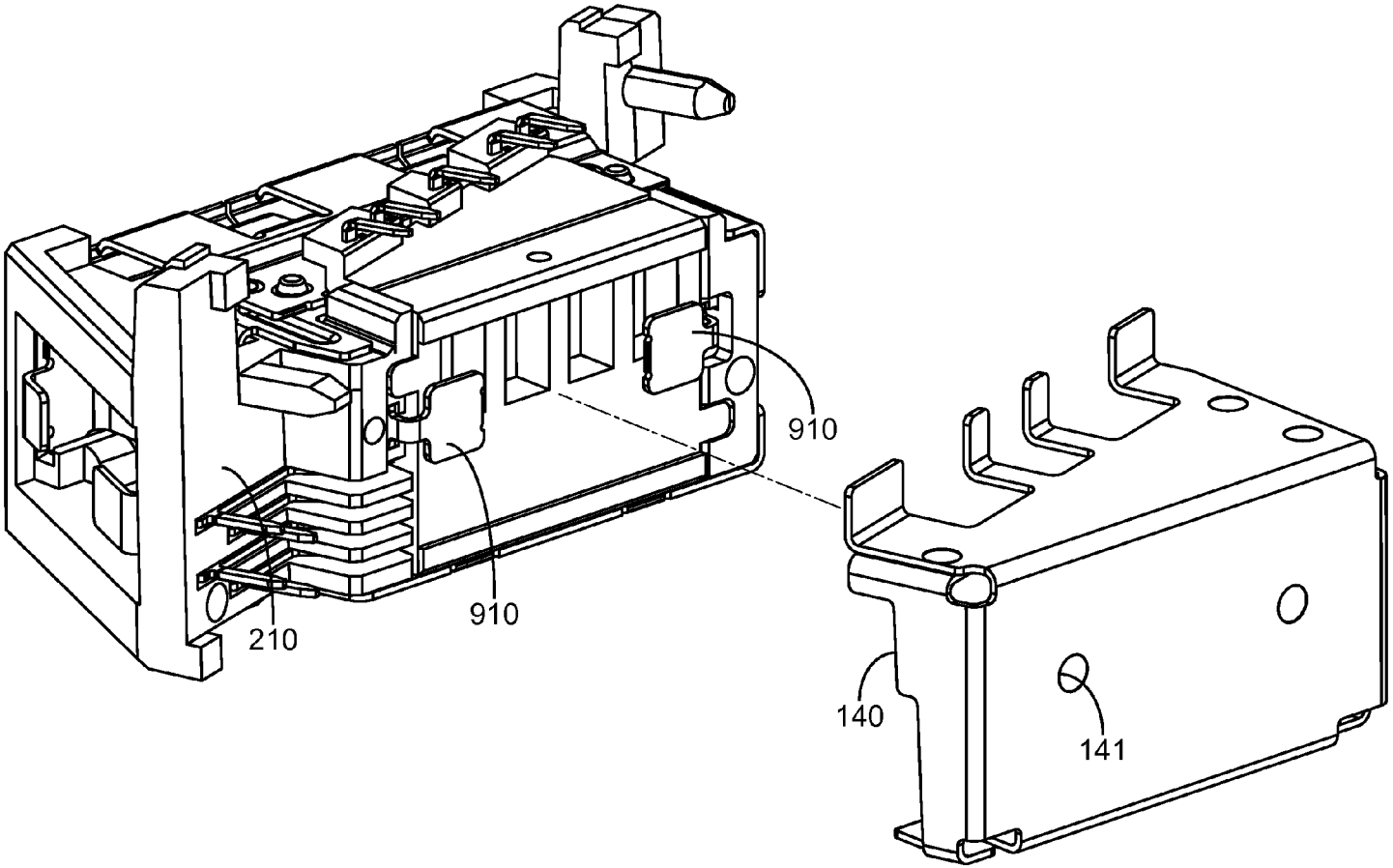

FIG. 10 illustrates another step in the manufacturing of a connector receptacle according to an embodiment of the present invention. In this figure, bottom shell 140 may be placed over a bottom portion of housing 210. Bottom shell 140 may be fixed to fingers 910 at points 141, for example by laser or spot welding, or other method.

Figure 11:
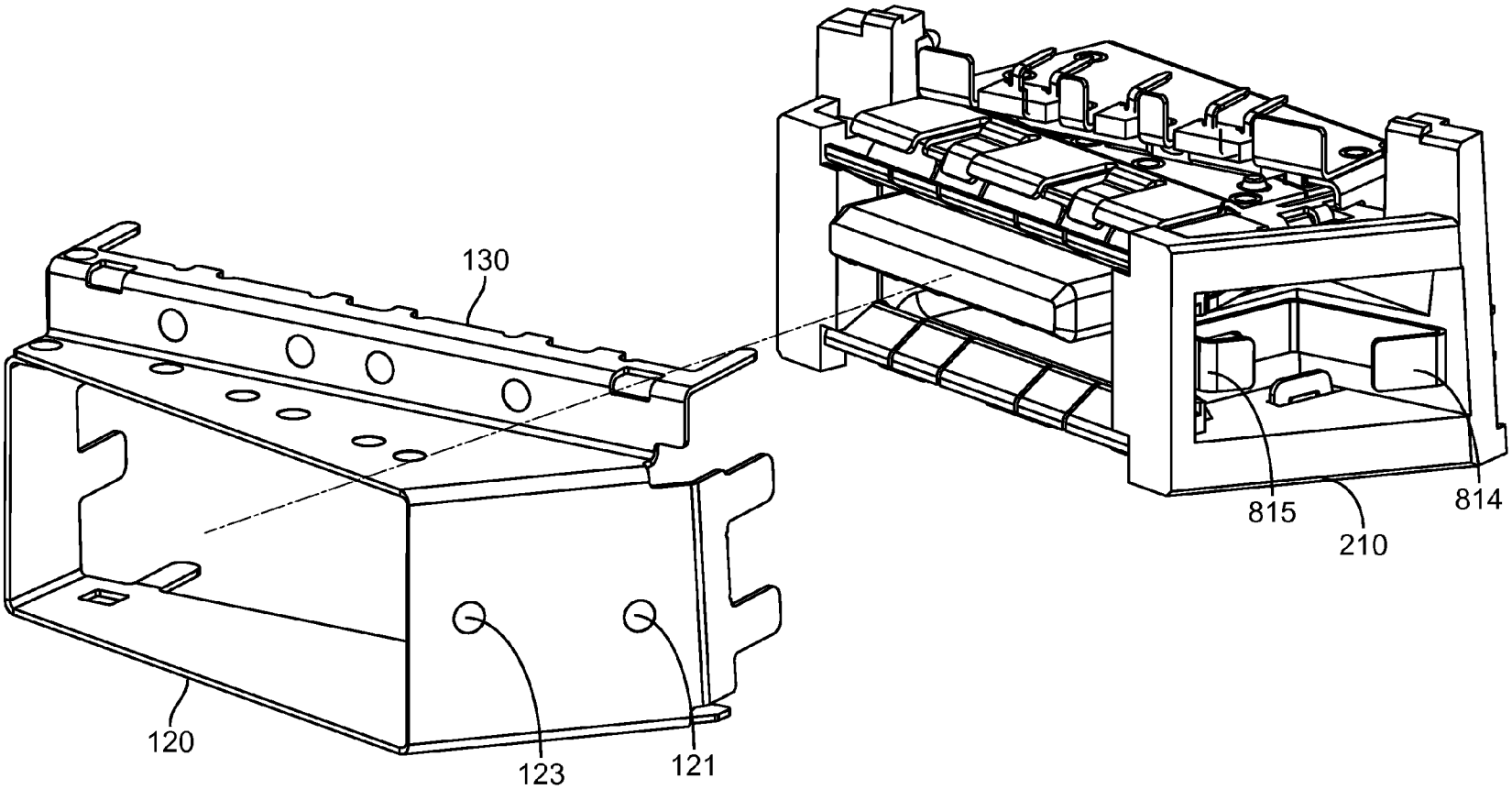

FIG. 11 illustrates another step in the manufacturing of connector receptacle according to an embodiment of present invention. In this figure, top shell portion 140 may be placed over a top portion of housing 210. Top shell portion 120 may be fixed to welding surfaces 814 and 815 at points 121 and 123. This may be done by spot or laser welding or other method.

Again, embodiments of the present invention may provide connector receptacles that are angled or tilted such that they may provide an opening flush against a highly stylized device enclosure. An example is shown in the following figure.

Figure 12:
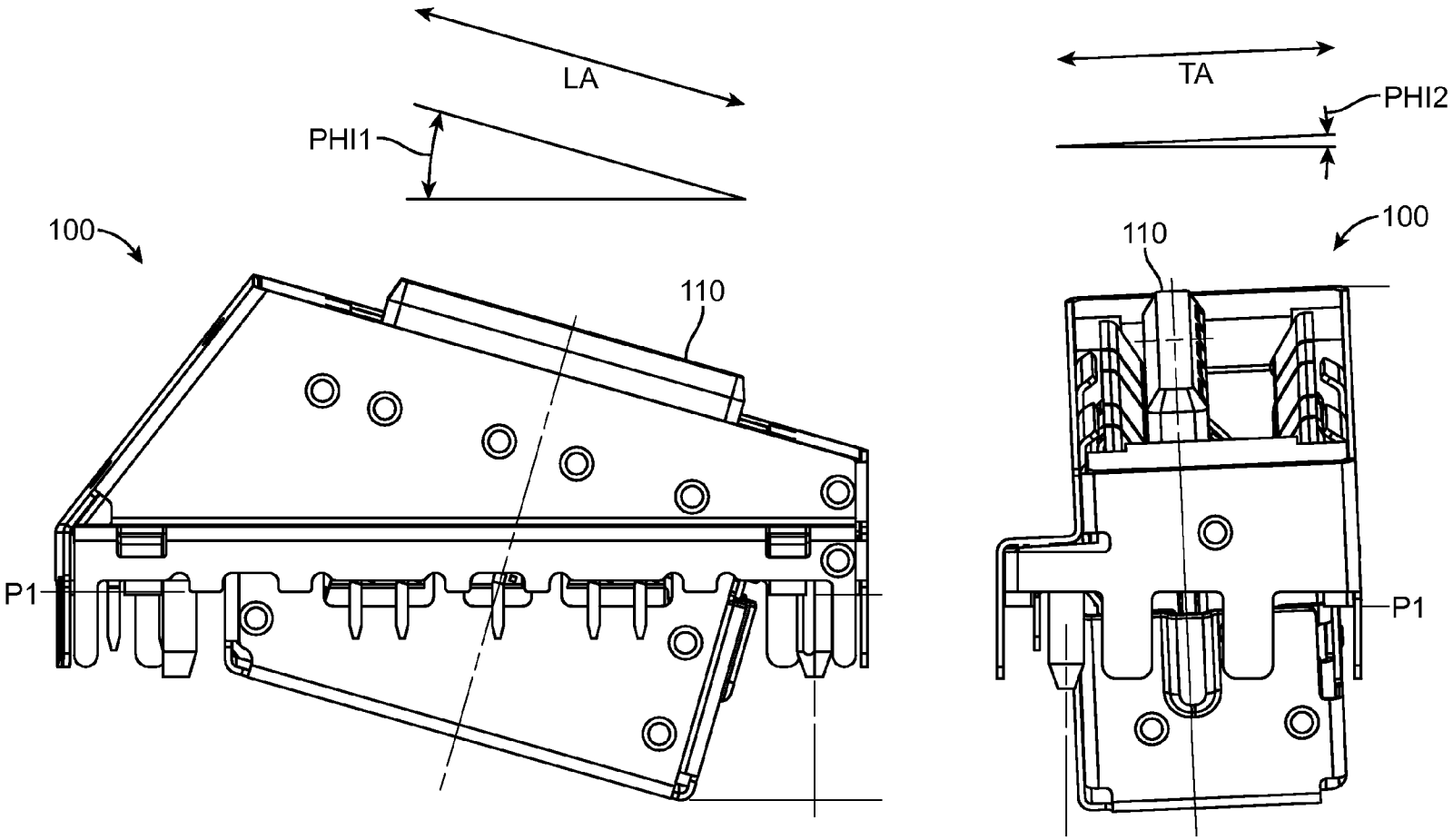
FIG. 12 illustrates front and side views of connector receptacle according to an embodiment of the present invention.

FIG. 12 illustrates front and side views of connector receptacle according to an embodiment of the present invention. Connector receptacle 100 may have a longitudinal axis LA and a transverse axis TA. Longitudinal axis LA may be at an angle PHI1 relative to a plane P1 of a printed circuit board. Similarly, transverse axis TA may be at an angle PHI2 relative to a plane P1 of a printed circuit board. That is, an opening of connector receptacle 100 may provide a face that is oblique to a plane P1 of the printed circuit board. Said another way, a face of an opening of connector receptacle 100 may be arranged such that is neither orthogonal nor parallel to a plane P1 of a printed circuit board. This may also be true for tongue 110. PHI1 and PHI2 may be the same or different angles.

Various portions of connector receptacle 100 may be formed of various materials. For example, the housings may be formed of silicon or silicone, rubber, hard rubber, plastic, nylon, liquid-crystal polymers (LCPs), or other nonconductive material or combination of materials. The contacts and terminals may be formed of copper, copper titanium, phosphor bronze, or other material. They may be plated or coated with nickel, gold, or other material.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a housing;

a tongue located in the housing;

a plurality of first contacts located on the tongue, each first contact having a first portion to make electrical contact with a corresponding contact on a connector insert, a second lateral portion at a right angle to the first portion, a third portion angled upward, a fourth lateral portion, and a fifth downward portion, the fifth downward portion forming a through-hole contact;

a plurality of second contacts located in the tongue, each second contact having a first portion to make electrical contact with a corresponding contact on a connector insert, a second lateral portion, a third portion angled upward, a fourth lateral portion, and a fifth downward portion, the fifth downward portion forming a through-hole contact;

a top shell portion covering at least a portion of a top of the housing; and a bottom shell portion covering at least a portion of a bottom of the housing.

2. The connector of claim 1 wherein the plurality of first contacts and the plurality of second contacts exit the housing at right angles to each other.

3. The connector of claim 1 wherein the top shell portion is arranged to contact a top side of a printed circuit board.

4. The connector of claim 3 wherein a substantial portion of the bottom shell portion is arranged to be located below a printed circuit board.

5. The connector of claim 4 further comprising a first ground contact above the tongue and a second ground contact below the tongue.

6. The connector of claim 1 wherein a face of the connector has a longitudinal axis in a first direction and a transverse axis in a second direction, the first direction orthogonal to the second direction, and wherein the connector is arranged such that the longitudinal axis is not parallel to or orthogonal to a printed circuit board supporting the connector and the transverse axis is not parallel to or orthogonal to the printed circuit board.

7. The connector of claim 1 wherein the tongue of the connector has a longitudinal axis in a first direction and a transverse axis in a second direction, the first direction orthogonal to the second direction, and wherein the connector is arranged such that the longitudinal axis forms an oblique angle to a printed circuit board supporting the connector and the transverse axis forms an oblique angle to the printed circuit board.

8. The connector of claim 1 wherein the connector is a Universal Serial Bus connector.

9. A connector comprising:

a housing;

a tongue located in the housing;

a plurality of first contacts located on the tongue; and a plurality of second contacts located in the tongue;

wherein the tongue of the connector has a longitudinal axis in a first direction and a transverse axis in a second direction, the first direction orthogonal to the second direction, and wherein the tongue is arranged such that the longitudinal axis forms an oblique angle to a printed circuit board supporting the connector and the transverse axis forms an oblique angle to the printed circuit board.

10. The connector of claim 9, wherein each of the plurality of first contacts includes a first portion to make electrical contact with a corresponding contact on a connector insert, a second lateral portion at a right angle to the first portion, a third portion angled upward, a fourth lateral portion, and a fifth downward portion, the fifth downward portion forming a through-hole contact.

11. The connector of claim 10, wherein each of the plurality of first contacts includes a first portion to make electrical contact with a corresponding contact on a connector insert, a second lateral portion, a third portion angled upward, a fourth lateral portion, and a fifth downward portion, the fifth downward portion forming a through-hole contact.

12. The connector of claim 11 wherein the plurality of first contacts and the plurality of second contacts exit the housing at right angles to each other.

13. The connector of claim 9 further comprising a top shell portion covering at least a portion of a top of the housing; and a bottom shell portion covering at least a portion of a bottom of the housing.

14. The connector of claim 13 wherein the top shell portion is arranged to contact a top side of a printed circuit board.

15. The connector of claim 14 wherein a substantial portion of the bottom shell portion is arranged to be located below a printed circuit board.

16. A connector comprising:

a plurality of first contacts inserted into a first housing portion;

a second housing formed around a plurality of second contacts, wherein the second housing is inserted into the first housing, and the first housing and the second housing are inserted into a third housing;

first and second ground contacts attached to a top and a bottom of the third housing;

a bottom shell portion substantially around a bottom portion of the third housing; and a top shell portion around sides of a top portion of the third housing, wherein a face of the connector has a longitudinal axis in a first direction and a transverse axis in a second direction, the first direction orthogonal to the second direction, and wherein the connector is arranged such that the longitudinal axis is not parallel to or orthogonal to a printed circuit board supporting the connector and the transverse axis is not parallel to or orthogonal to the printed circuit board.

17. The connector of claim 16 wherein the plurality of first contacts and the plurality of second contacts exit the housing at right angles to each other.

18. A connector comprising:

a plurality of first contacts inserted into a first housing portion;

a second housing formed around a plurality of second contacts, wherein the second housing is inserted into the first housing, and the first housing and the second housing are inserted into a third housing;

first and second ground contacts attached to a top and a bottom of the third housing;

a bottom shell portion substantially around a bottom portion of the third housing; and a top shell portion around sides of a top portion of the third housing, wherein the tongue of the connector has a longitudinal axis in a first direction and a transverse axis in a second direction, the first direction orthogonal to the second direction, and wherein the tongue is arranged such that the longitudinal axis forms an oblique angle to a printed circuit board supporting the connector and the transverse axis forms an oblique angle to the printed circuit board.

19. The connector of claim 18 wherein the connector is a Universal Serial Bus connector.

20. The connector of claim 18 wherein the plurality of first contacts and the plurality of second contacts exit the housing at right angles to each other.

* * * * *